US007134655B2

(12) United States Patent
Terao et al.

(10) Patent No.: US 7,134,655 B2
(45) Date of Patent: Nov. 14, 2006

(54) WAITING TRAY FOR SHEET PROCESSING TRAY

(75) Inventors: Yasunobu Terao, Tagata-gun (JP); Hiroyuki Taki, Tagata-gun (JP); Mikio Yamamoto, Tagata-gun (JP); Hajime Yamamoto, Mishima (JP); Yoshiaki Sugizaki, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,251

(22) Filed: Dec. 10, 2004

(65) Prior Publication Data

US 2006/0066024 A1 Mar. 30, 2006

(30) Foreign Application Priority Data

Sep. 28, 2004 (JP) ..... 2004-282210

(51) Int. Cl.
*B65H 37/04* (2006.01)

(52) U.S. Cl. ..... 270/58.14; 270/58.08; 270/58.11; 270/58.18; 399/410

(58) Field of Classification Search ..... 270/58.08, 270/58.11, 58.12, 58.13, 58.14, 58.18; 399/410; 271/189, 190, 191, 192
See application file for complete search history.

(56) References Cited

U.S. PATENT DOCUMENTS

| | | | | |
|---|---|---|---|---|
| 4,473,425 | A | | 9/1984 | Baughman et al. |
| 4,611,741 | A | | 9/1986 | Wilson |
| 4,794,859 | A | | 1/1989 | Huseby et al. |
| 4,898,374 | A | | 2/1990 | Vermaat |
| 5,098,074 | A | | 3/1992 | Mandel et al. |
| 5,112,034 | A | | 5/1992 | Uto et al. |
| 5,282,611 | A | | 2/1994 | Ueda et al. |
| 5,285,249 | A | | 2/1994 | Mahoney |
| 5,289,251 | A | | 2/1994 | Mandel et al. |
| 5,435,544 | A | * | 7/1995 | Mandel ..... 271/298 |
| 5,451,037 | A | | 9/1995 | Lundstrom |
| 5,628,502 | A | | 5/1997 | Amarakoon |
| 5,676,517 | A | | 10/1997 | Lotz |
| 5,709,376 | A | | 1/1998 | Ushirogata |
| 5,934,140 | A | | 8/1999 | Jackson et al. |
| 5,961,274 | A | | 10/1999 | Bors |
| 5,971,384 | A | | 10/1999 | Asao |
| 6,065,747 | A | | 5/2000 | Khovaylo et al. |

(Continued)

FOREIGN PATENT DOCUMENTS

| | | | |
|---|---|---|---|
| JP | 62-008965 | A | 1/1987 |

(Continued)

OTHER PUBLICATIONS

U.S. Appl. No. 11/008,122, filed Dec. 10, 2004, Sasahara.

(Continued)

*Primary Examiner*—Patrick Mackey
(74) *Attorney, Agent, or Firm*—Foley & Lardner LLP

(57) ABSTRACT

A waiting tray is provided in a sheet-conveying path and holds sheets if the sheets need to be post-processed. A processing tray receives sheets conveyed from the waiting tray. It may receive sheets conveyed through the sheet-conveying path and coming not via the waiting tray, before the sheets are post-processed. A conveying mechanism is provided, which causes the sheets to fall, due to gravity, from the waiting tray onto a processing tray. A sheet-aligning mechanism aligns the sheets on the processing tray, at their transverse edges and longitudinal edges. On the processing tray, the sheets are post-processed, forming a bundle. A third storage tray holds the sheets ejected without being conveyed to the waiting tray or the processing tray.

20 Claims, 12 Drawing Sheets

U.S. PATENT DOCUMENTS

| | | | | |
|---|---|---|---|---|
| 6,092,948 | A | 7/2000 | Altfather | |
| 6,231,039 | B1 | 5/2001 | Chung | |
| 6,231,045 | B1 | 5/2001 | Yamada et al. | |
| 6,322,070 | B1 | 11/2001 | Yamada et al. | |
| 6,330,999 | B1 | 12/2001 | Coombs et al. | |
| 6,336,630 | B1 * | 1/2002 | Holtman et al. | 271/293 |
| 6,354,059 | B1 | 3/2002 | Yoshie et al. | |
| 6,416,052 | B1 | 7/2002 | Yamada et al. | |
| 6,450,934 | B1 | 9/2002 | Coombs | |
| 6,631,896 | B1 | 10/2003 | Yamada et al. | |
| 6,641,129 | B1 | 11/2003 | Ogita et al. | |
| 6,671,492 | B1 | 12/2003 | Mimura et al. | |
| 6,698,744 | B1 | 3/2004 | Yamada et al. | |
| 6,712,349 | B1 | 3/2004 | Watanabe | |
| 6,722,646 | B1 | 4/2004 | Sekiyama et al. | |
| 6,733,006 | B1 | 5/2004 | Kobayashi et al. | |
| 6,819,906 | B1 | 11/2004 | Herrmann et al. | |
| 6,824,128 | B1 | 11/2004 | Nagata et al. | |
| 2002/0047233 | A1 | 4/2002 | Coombs et al. | |
| 2002/0163119 | A1 | 11/2002 | Kawata | |
| 2004/0113348 | A1 | 6/2004 | Awano | |
| 2004/0126163 | A1 | 7/2004 | Asami et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 6-99070 | B2 | 12/1994 |
| JP | 2000-53308 | A | 2/2000 |
| JP | 2001089009 | A * | 4/2001 |
| JP | 2003-081517 | A | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao, et al., Notice of Allowance and Fee(s) Due, U.S. Appl. No. 11/008,124, filed Sep. 30, 2005, 9 pages.
Y. Terao, et al., Notice of Allowance and Fee(s) Due, U.S. Appl. No. 11/008,132, filed Oct. 6, 2005, 9 pages.
Y. Terao, et al., U.S. Appl. No. 11/008,122, filed Nov. 21, 2005, 9 pages.
Y. Terao, et al., U.S. Appl. No. 11/008,124, filed Nov. 21, 2005, 10 pages.
Y. Terao, et al., U.S. Appl. No. 11/008,257, filed Nov. 30, 2005, 9 pages.
Y. Terao, et al., U.S. Appl. No. 11/008,271, filed Nov. 30, 2005, 9 pages.
Y. Terao, et al., U.S. Appl. No. 11/008,290, filed Nov. 30, 2005, 9 pages.
K. Sasahara, et al., U.S. Appl. No. 11/008,122, filed Apr. 19, 2006, 10 pages.
Y. Terao, et al., Notice of Allowance and Fee(s) Due, U.S. Appl. No. 11/008,199, filed Apr. 20, 2006, 15 pages.
Y. Terao, et al., Notice of Allowance and Fee(s) Due, U.S. Appl. No. 11/008,247, filed May 1, 2006, 16 pages.
Y. Terao, et al., Notice of Allowance and Fee(s) Due, U.S. Appl. No. 11/008,349, filed May 2, 2006, 9 pages.
Y. Terao, et al., U.S. Appl. No. 11/008,244, filed Apr. 21, 2006, 12 pages.
Y. Terao, et al., U.S. Appl. No. 11/008,257, filed Apr. 28, 2006, 13 pages.
Y. Terao, et al., U.S. Appl. No. 11/008,271, filed Apr. 25, 2006, 14 pages.
Y. Terao, et al., U.S. Appl. No. 11/008,294, filed May 5, 2006, 13 pages.
Y. Terao, et al., U.S. Appl. No. 11/008,299, filed May 5, 2006, 12 pages.
Y. Terao, et al., U.S. Appl. No. 11/008,392, filed Apr. 26, 2006, 10 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. Appl. No. 11/085,243, Jan. 5, 2006, with attached Notice of Withdrawal from Issue date Jan. 10, 2006, 10 pgs.
Y. Terao et al., U.S. Appl. No. 11/008,131, filed Feb. 23, 2006, 9 pgs.
Y. Terao et al., U.S. Appl. No. 11/008,222, filed Feb. 24, 2006, 12 pgs.
Y. Terao et al., U.S. Appl. No. 11/008,230, filed Feb. 24, 2006, 11 pgs.
Y. Terao et al., U.S. Appl. No. 11/085,226, filed Jan. 13, 2006, 9 pgs.
Y. Terao et al., U.S. Appl. No. 11/085,227, filed Feb. 9, 2006, 9 pgs.
Y. Terao et al., U.S. Appl. No. 11/085,240, filed Jan. 26, 2006, 8 pgs.
Y. Terao et al., U.S. Appl. No. 11/085,241, filed Feb. 9, 2006, 9 pgs.
Y. Terao, et al., U.S. Appl. No. 11/085,243, filed Jan. 26, 2006, 6 pgs.
Y. Terao et al., U.S. Appl. No. 11/085,244, filed Feb. 9, 2006, 7 pgs.
Y. Terao et al., U.S. Appl. No. 11/008,148, filed Jan. 11, 2006, 12 pages.
Y. Terao et al., U.S. Appl. No. 11/008,295, filed Jan. 5, 2006, 11 pages.
Y. Terao et al., U.S. Appl. No. 11/008,350, filed Jan. 26, 2006, 12 pages.
Y. Terao et al., U.S. Appl. No. 11/008,392, filed Dec. 14, 2005, 9 pages.
Y. Terao et al., U.S. Appl. No. 11/008,294, filed Dec. 13, 2005, 9 pages.
Y. Terao et al., U.S. Appl. No. 11/008,299, filed Dec. 13, 2005, 9 pages.
Y. Terao et al., U.S. Appl. No. 11/008,349, filed Dec. 13, 2005, 9 pages.
Y. Terao et al., U.S. Appl. No. 11/008,567, filed Dec. 13, 2005, 9 pages.
Y. Terao et al., Notice of Allowance and Fee(s) Due, Serial No. 11/085,244, Jul. 13, 2006, 10 pages.
Y. Terao et al., U.S. PTO Office Action, Serial No. 11/085,226, Jul. 20, 2006, 12 pages.
Y. Terao et al., U.S. PTO Office Action, Serial No. 11/085,227, Aug. 11, 2006, 15 pages.

Y. Terao et al., U.S. PTO Office Action, Serial No. 11/085,240, Aug. 2, 2006, 15 pages.
Y. Terao et al., U.S. PTO Office Action, Serial No. 11/008,145, Jun. 30, 2006, 6 pgs.
Y. Terao et al., U.S. PTO Office Action, Serial No. 11/008,147, Jul. 07, 2006, 4 pgs.
Y. Terao et al., U.S. PTO Office Action, Serial No. 11/008,290, Jul. 21, 2006, 15 pgs.
Y. Terao et al., U.S. PTO Office Action, Serial No. 11/008,350, Jul. 6, 2006, 12 pgs.
Y. Terao et al., U.S. PTO Office Action, Serial No. 11/085,247, Jul. 13, 2006, 14 pgs.
Y. Terao et al., U.S. PTO Office Action, Serial No. 11/085,248, Jul. 5, 2006, 15 pgs.
Y. Terao et al., U.S. PTO Office Action, Serial No. 11/085,256, Jul. 13, 2006, 13 pgs.
Y. Terao et al., U.S. PTO Office Action, Serial No. 11/085,625, Jul. 28, 2006, 13 pgs.
Y. Terao, et al., Notice of Allowance and Fee(s) Due, Serial No. 11/008,122, Jul. 26, 2006, 8 pgs.
Y. Terao et al., U.S. PTO Office Action, Serial No. 11/008,381, Aug. 23, 2005, 17 pages.
Y. Terao et al., U.S. PTO Office Action, Serial No. 11/008,567, Aug. 21, 2006, 14 pages.
Y. Terao, et al., Notice of Allowance and Fee(s) Due, Serial No. 11/008,222, Aug. 31, 2006, 12 pgs.
Y. Terao, et al., Notice of Allowance and Fee(s) Due, Serial No. 11/008,299, Sep. 6, 2006, 9 pgs.

* cited by examiner

WAITING TRAY FOR SHEET PROCESSING TRAY

CROSS-REFERENCE TO RELATED APPLICATIONS

This application is based upon and claims the benefit of priority from prior Japanese Patent Application No. 2004-282210, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function periperal (MFP).

2. Description of the Related Art

An apparatus called "finisher" is known, which receives printed sheets supplied from an MFP and staples them together. In the finisher, the sheets supplied from the MFP are sequentially conveyed to a tray and stapled by a stapler, forming a bundle of sheets. The bundle of sheets is ejected from the apparatus onto a storage tray.

Jpn. Pat. Appln. KOKAI Publication No. 6-99070 discloses a finisher. This finisher performs a post-process on sheets. In the post-process, a stapler staples sheets. To process the sheets at the same rate as the MFP processes them, it is necessary to reduce the speed at which sheets are conveyed in the finisher. The finisher therefore has a long sheet-conveying path.

Having a long sheet-conveying path, the finisher cannot be as small as desired.

Jpn. Pat. Appln. KOKAI Publication 2000-53308 discloses a finisher, too. This finisher has a storage tray that is used only when no stapling processes are performed.

BRIEF SUMMARY OF THE INVENTION

An object of the present invention is to provide a sheet post-process apparatus that serves to shorten the time required for fast copying.

A sheet post-process apparatus according to this invention comprises: a plurality of rollers which receive sheets from an MFP and convey the sheets forward; a waiting tray which is provided in a conveying path and holds the sheets conveyed from the rollers when the sheets need to be post-processed; a processing tray which holds the sheets conveyed from the waiting tray and the sheets conveyed via the conveying path without being conveyed to the waiting tray, before the sheets are post-processed; a conveying mechanism which causes the sheets to fall, due to gravity, from the waiting tray onto the processing tray; a sheet-aligning mechanism which aligns the sheets with one another on the processing tray, at transverse edge and longitudinal edge, thereby forming a bundle of sheets; a post-process mechanism which performs a post-process on the bundle of sheets on the processing tray; sheet-conveying means for conveying the bundle of sheets from the processing tray; a first storage tray and a second storage tray, each of which holds the bundle of sheets conveyed from the processing tray; and a third storage tray which holds sheets ejected without being conveyed to the waiting tray or the processing tray.

Preferably, the third storage tray may have a cover that can be opened and closed.

Preferably, the sheet post-process apparatus may further comprise a gating device which guides sheets to the third storage tray or the waiting tray.

In the apparatus, the waiting tray holds sheets to be post-processed. The conveying mechanism causes these sheets to fall, due to gravity, onto the processing tray. Hence, it suffices to provide a sheet-waiting section that is just as long as the waiting tray. This renders the sheet post-process apparatus small.

The post-process apparatus has the third storage tray that holds sheets ejected without being conveyed to the waiting tray or the processing tray. The path through which these sheets are conveyed to the third storage tray is short. The end-user of the apparatus need not wait long to obtain the sheets. The apparatus can shorten, in particular, the time required for fast copying.

DETAILED DESCRIPTION OF THE INVENTION

An embodiment of this invention will be described, with reference to the accompanying drawings.

Figure 1:
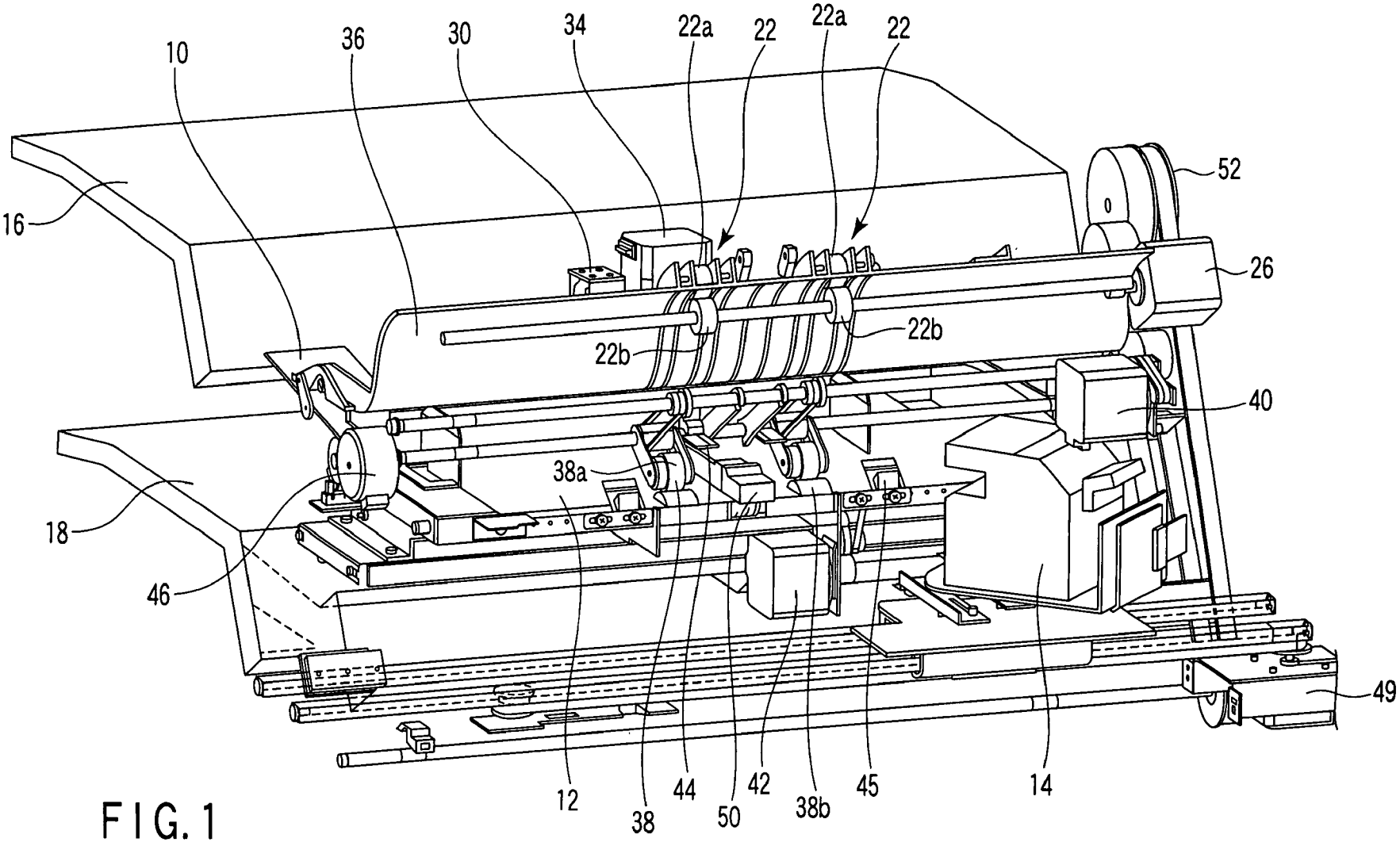
FIG. 1 is a perspective view of a post-process apparatus according to this invention.
Figure 2:
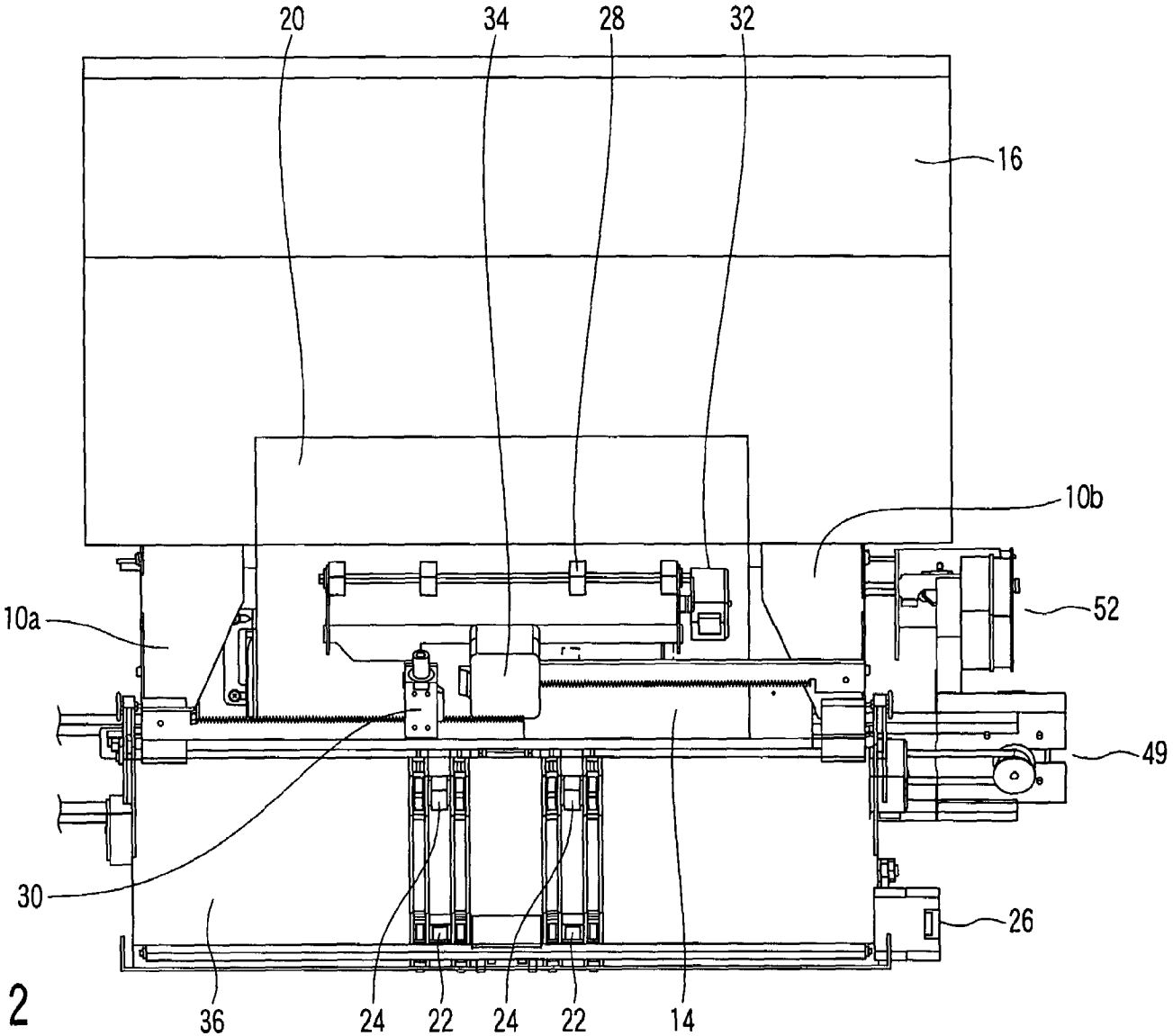
FIG. 2 is a top view of the post-process apparatus according to the invention.

FIG. 1 is a perspective view of a section of a sheet post-process apparatus according to this invention. FIG. 2 is a top view of said section of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

The waiting tray 10 comprises two tray parts 10*a* and 10*b*. The tray parts 10*a* and 10*b* can move from left to right, and vice versa. When the tray parts 10*a* and 10*b* take a closed position, the waiting tray 10 can receive sheets. Waiting-tray rollers 28, a waiting-roller drive 30 and a waiting-roller motor 32 are provided. The waiting-tray rollers 28 align sheets on the tray parts 10*a* and 10*b* while both tray parts remain in the closed position. The waiting-tray rollers 28 can move up and down when they are driven and controlled by the waiting-roller drive 30. The waiting-roller motor 32 rotates the waiting-tray rollers 28.

Figure 3:
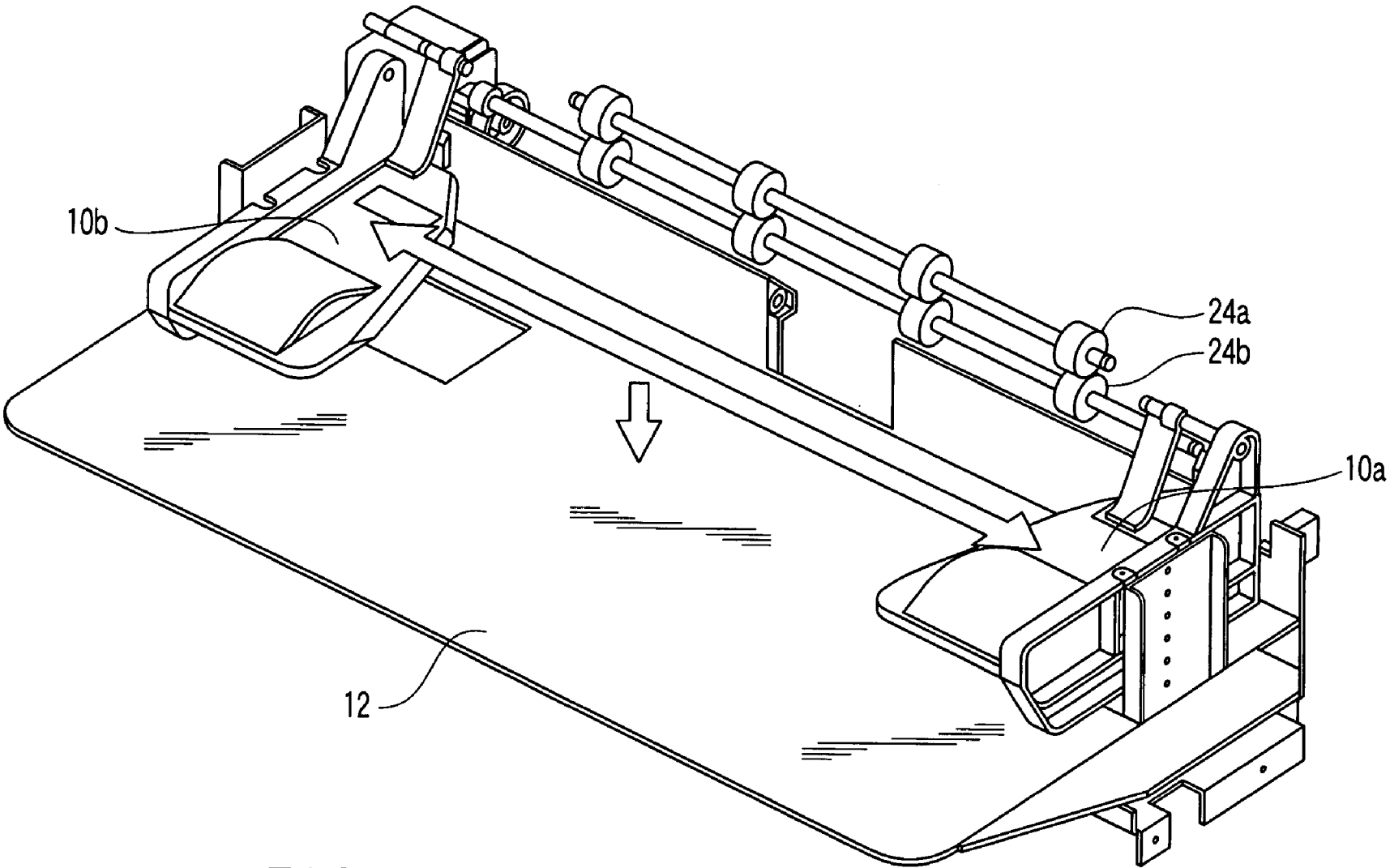
FIG. 3 is a perspective view illustrating how the waiting tray of the post-process apparatus performs its function.

When the number of sheets 20 stacked on the waiting tray 10 reaches a prescribed value, a waiting-tray motor 34 drives the waiting-tray parts 10*a* and 10*b* to an opened position as is illustrated in FIG. 3. The sheets 20 fall onto the processing tray 12, due to gravity. This event is known as "active drop."

The sheet post-process apparatus has a paper guide 36, which guides sheets from the MFP to the waiting tray 10 and thence to the processing tray 12. The paper guide 36 has a paper-pass ceiling.

Figure 4:
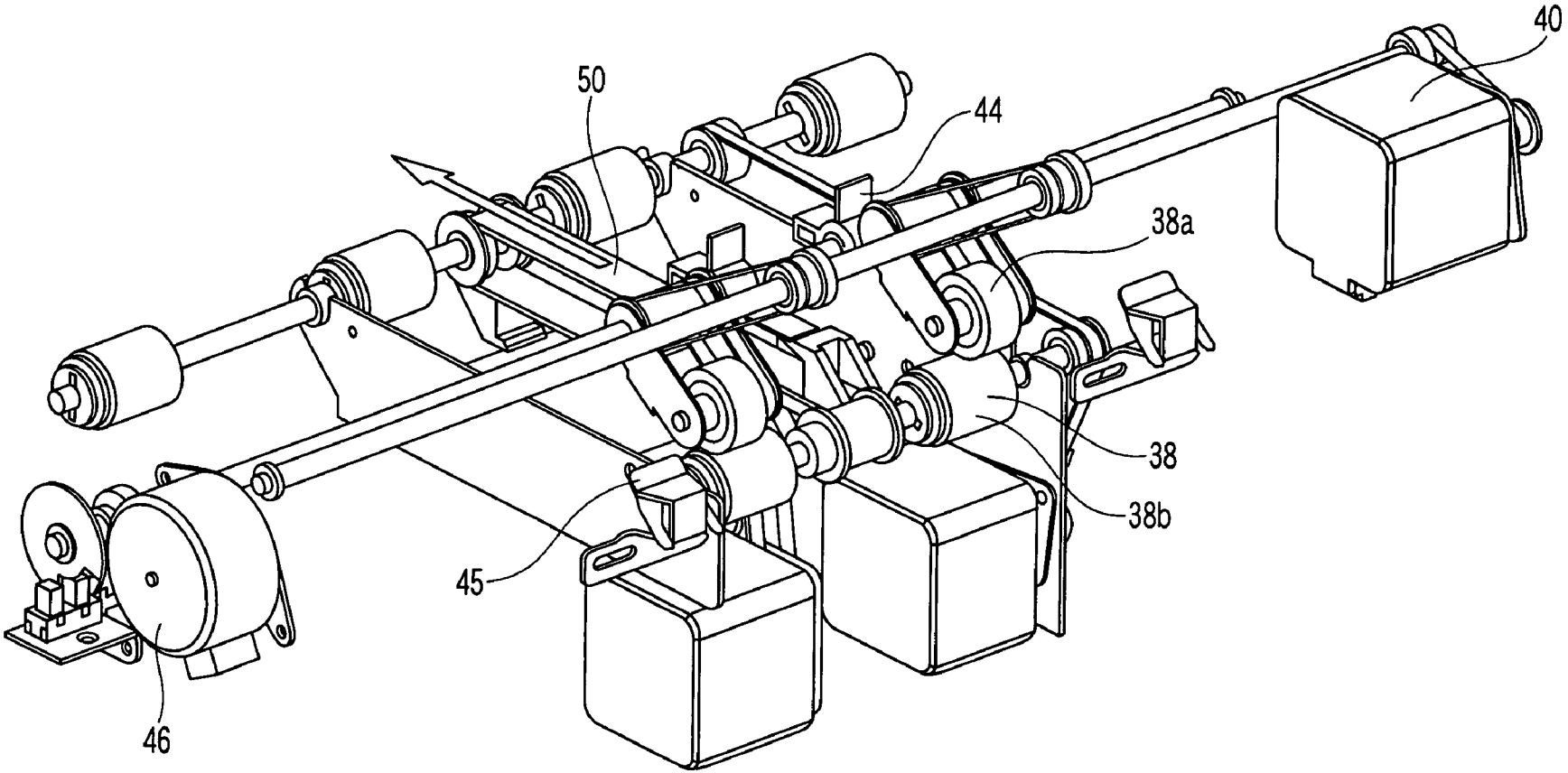
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges and the transverse edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 5:
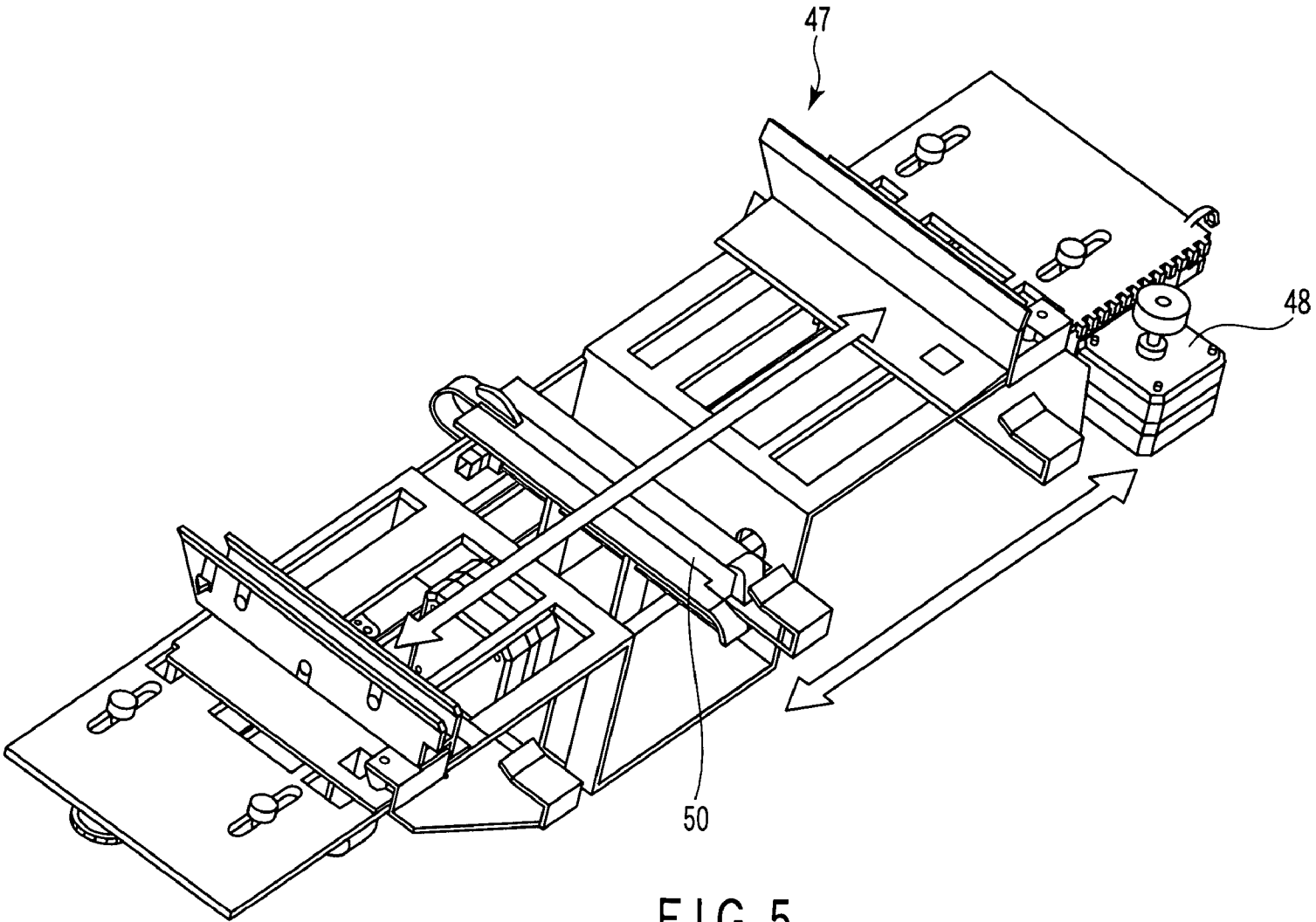
FIG. 5 is a perspective view showing the mechanism for aligning sheets at their transverse edges.

The sheets are aligned at their transverse edges, too, as is illustrated in FIG. 5. More specifically, the transverse alignment is performed by a transverse-alignment mechanism 47 and a transverse-alignment motor 48.

Figure 6:
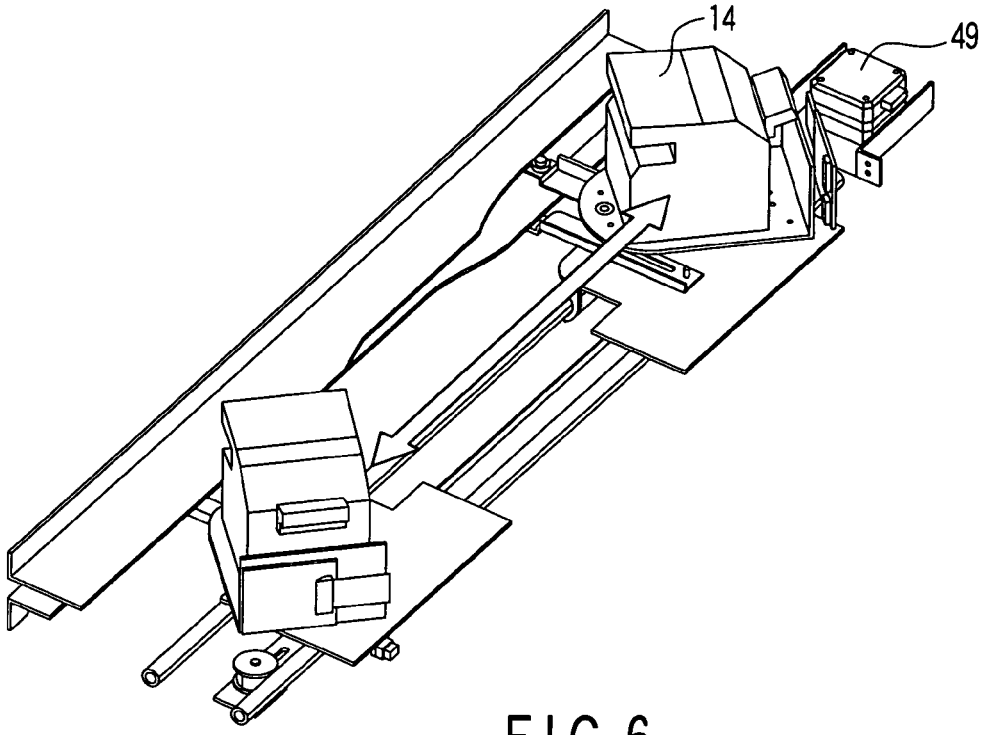
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 (FIG. 2) moves the tray 16 or 18 to a predetermined upper position.

Figure 7:
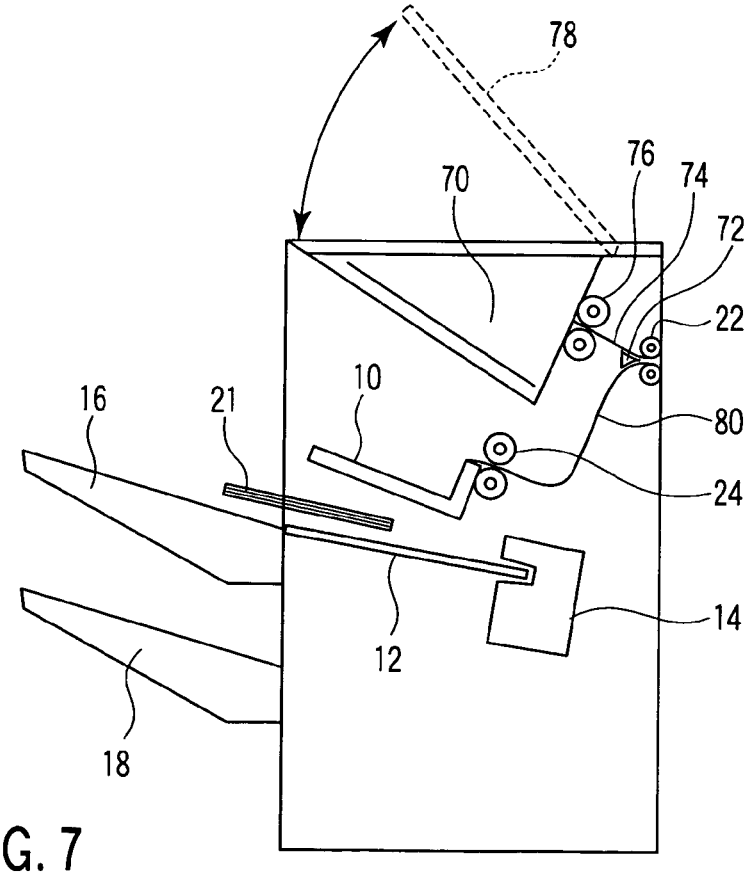
FIG. 7 is a side view of the post-process apparatus according to the invention
Figure 8:
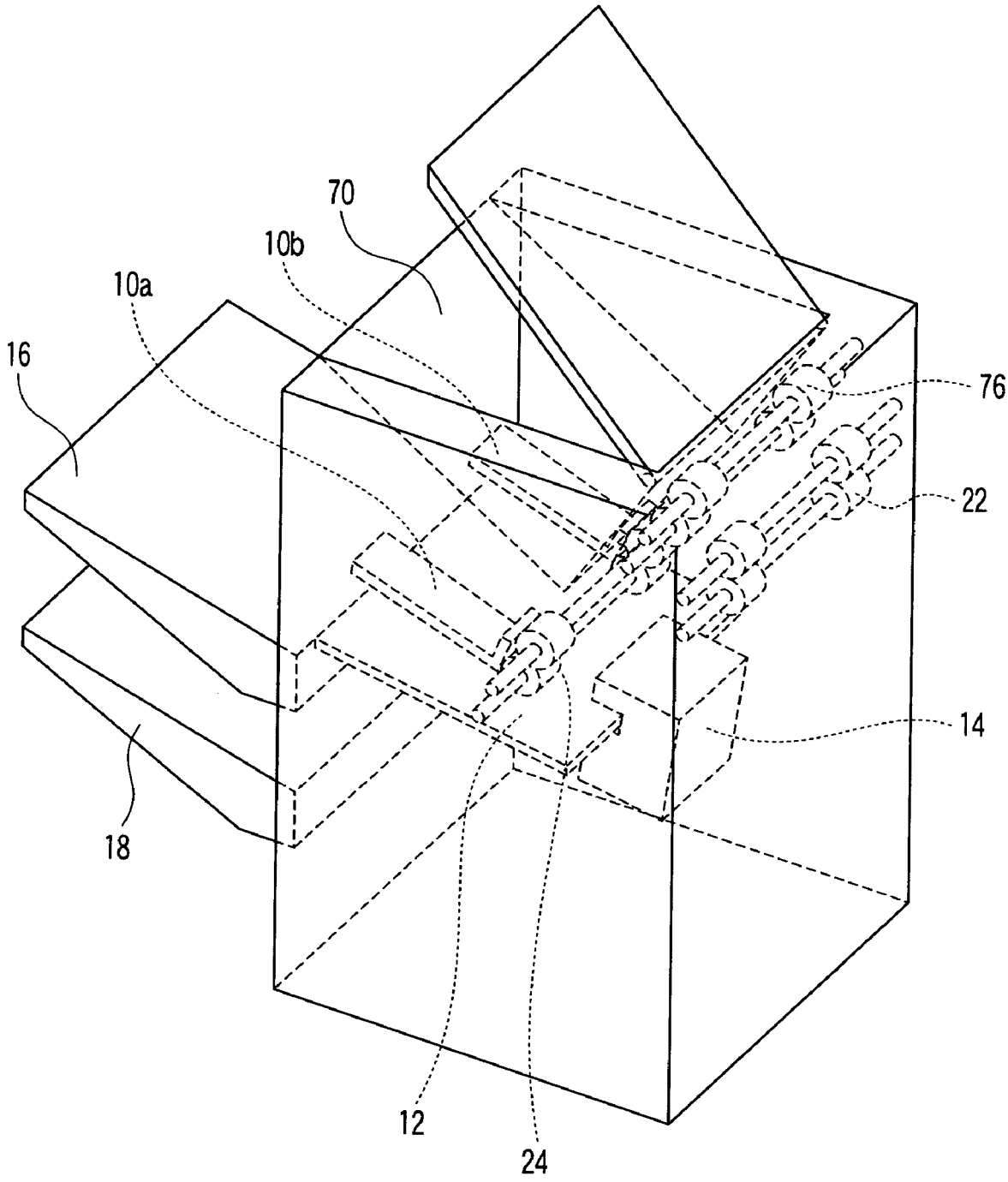
FIG. 8 is a perspective view of the post-process apparatus according to this invention.

FIG. 7 is a side view of the post-process apparatus according to the invention. FIG. 8 is a perspective view of the post-process apparatus. As FIGS. 7 and 8 show, the post-process apparatus has a third storage tray 70. Sheets 20 are ejected onto this storage tray 70 after conveyed from the input rollers 22, guided by a gating device 72 and a second guide 74 and conveyed by sheet-ejecting rollers 76. The sheets 20 conveyed through the path defined by the rollers 22, device 72, guide 74 and rollers 76 are ejected onto the third storage tray 70, not passing by the waiting tray 10, the processing tray 12 or the stapler 14. Hence, they can be conveyed at a higher speed than otherwise.

Sheets 20 that must be post-processed are conveyed from the input rollers 22, guided to the sheet-feeding rollers 24 by the gating device 72 and the first guide 80, thence to the waiting tray 10, the processing tray 12 and the stapler 14. The stapler 14 staples the sheets 20, forming a bundle 21. The bundle 21 of sheets is ejected onto the first storage tray 16 or the second storage tray 18. The first storage tray 16 or the second storage tray 18 is selected by the user of the post-process apparatus. The storage trays 16 and 18 may be dedicated, each to a specific office section or to a particular person.

The third storage tray 70 may have a cover 78. If the cover 78 is locked, any person other than the holder of the key to the lock cannot read or take out the document sheets from the third storage tray 70.

The third storage tray 70 need not have a cover 78, of course. Whether the tray 70 has a cover or not, the document sheets not subjected to a post-process, such as stapling, can be ejected onto the third storage tray 70, directly from the input rollers 22 via the sheet-ejecting rollers 76. Namely, these sheets reach the tray 70, passing through a short path. This enhances the throughput of document processing.

How the post-process apparatus according to this invention operates will be explained with reference to FIGS. 9 to 18.

Figure 9:
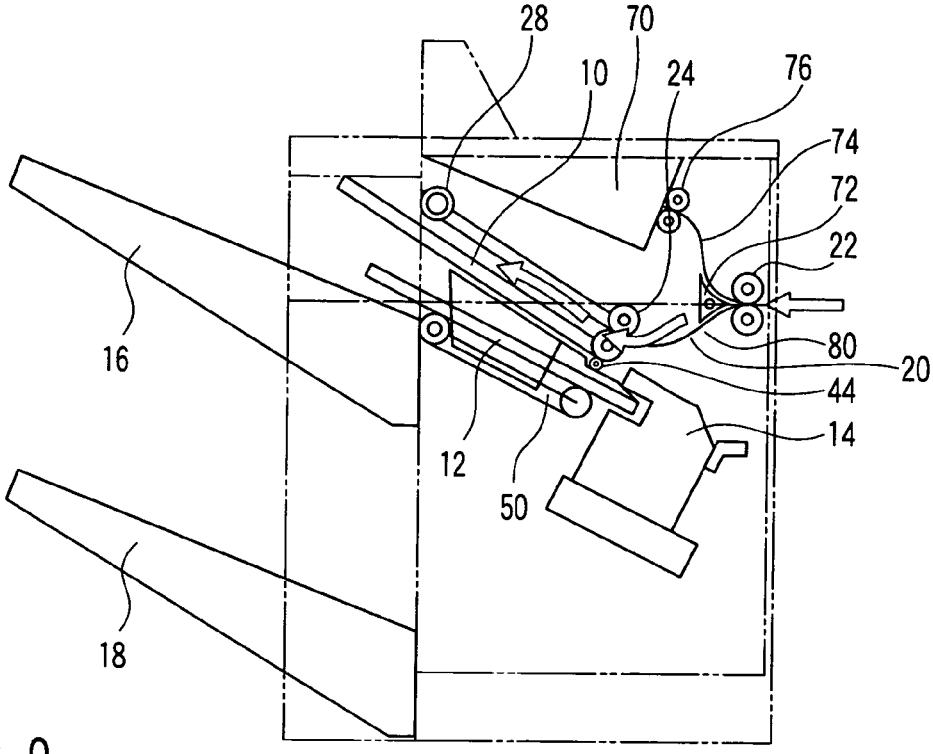
FIG. 9 is a sectional view of the post-process apparatus, showing how the first sheet moves from the input rollers to the sheet-feeding roller.

As FIG. 9 shows, a sheet 20 conveyed from the MFP is moved from the input rollers 22 to the sheet-feeding rollers 24, in the direction of the arrow.

Figure 10:
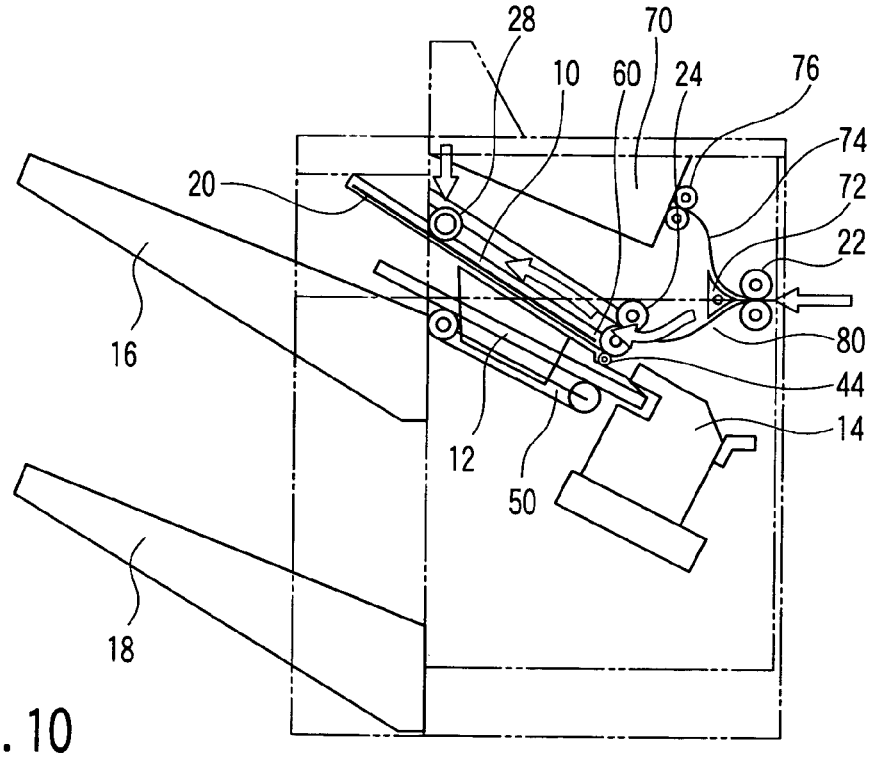
FIG. 10 is a sectional view of the apparatus, explaining how the first sheet moves from the sheet-feeding rollers to the waiting tray.

As is illustrated in FIG. 10, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 11:
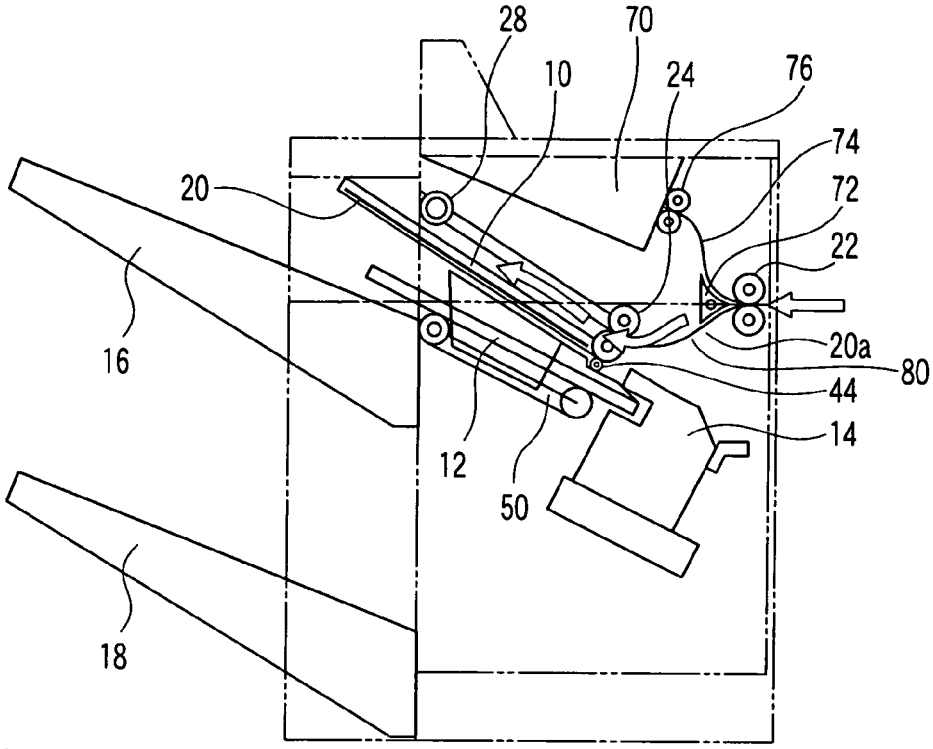
FIG. 11 is a sectional view of the apparatus, explaining how the second sheet moves from the sheet-feeding rollers to the waiting tray.

As FIG. 11 depicts, the waiting-tray rollers 28 moves up to receive the second sheet 20*a*.

Figure 12:
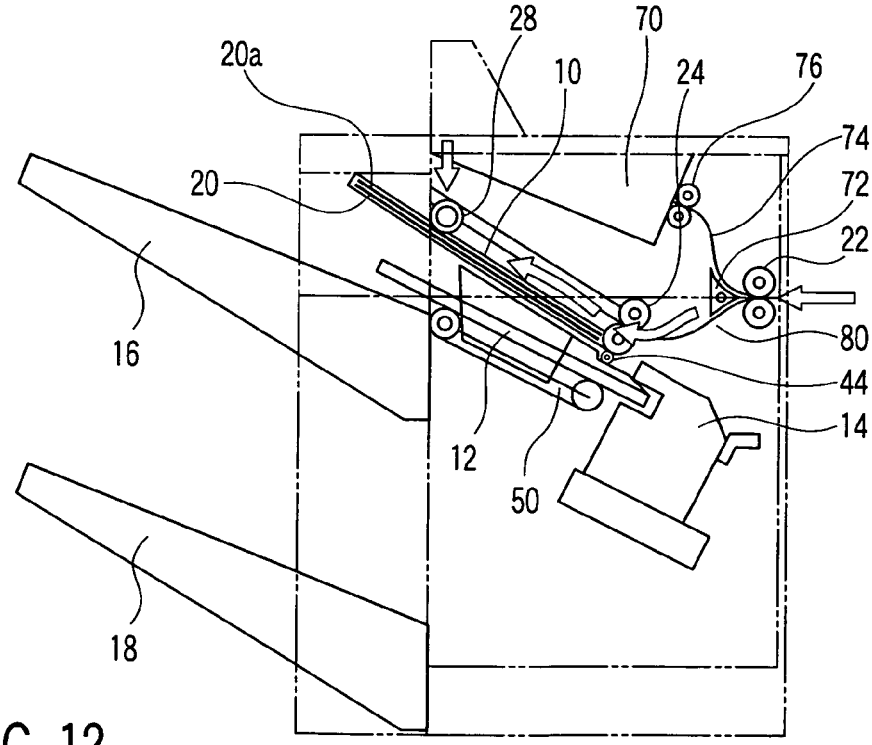
FIG. 12 is a sectional view of the post-process apparatus, showing how the waiting-tray rollers operate.

As FIG. 12 shows, the second sheet 20 is conveyed to the waiting tray 10. The waiting-tray rollers 28 move down, aligning the trailing edge of the second sheet 20*a* at the rear end 60 of the waiting tray 10. Thus, a bundle 20*b* of two sheets 20 and 20*a* is formed in the waiting tray 10.

Figure 13:
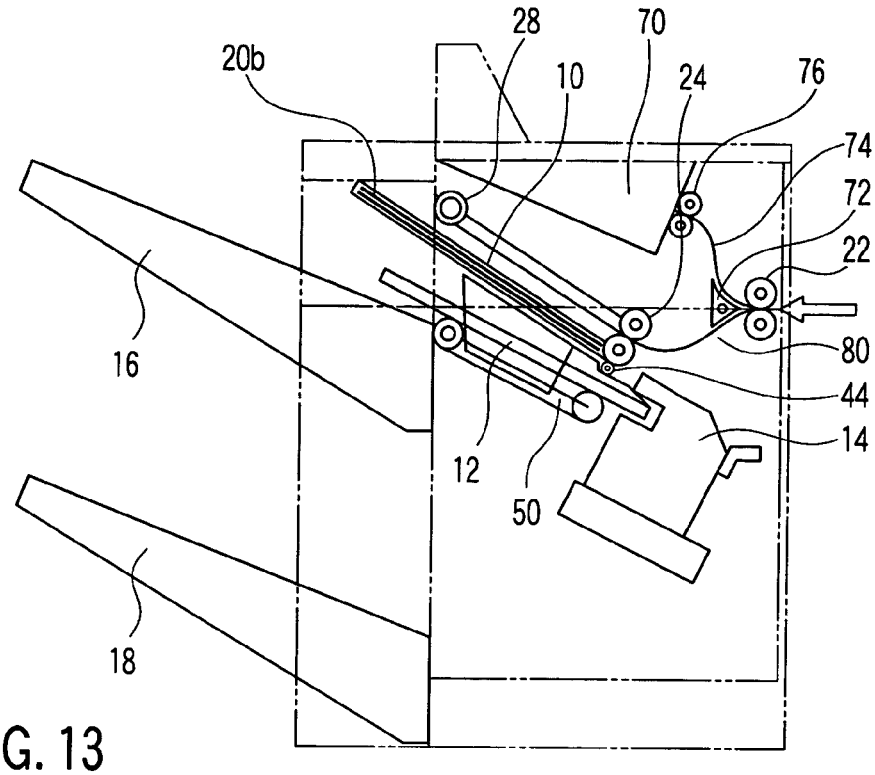
FIG. 13 is another sectional view of the apparatus, illustrating how the waiting-tray rollers operate.
Figure 14:
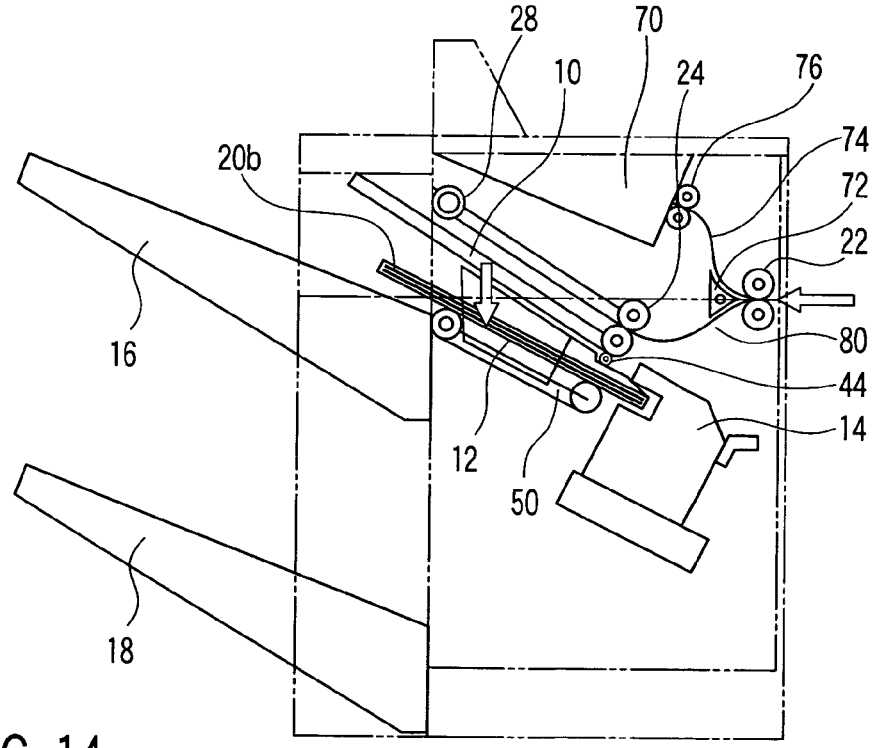
FIG. 14 is a sectional view of the apparatus, explaining how an active drop is carried out.

As FIG. 13 shows, the waiting-tray rollers 28 move upwards. Then, the waiting-tray parts 10*a* and 10*b* move to the opened position as is illustrated in FIG. 3. The active drop is therefore performed as shown in FIG. 14. The bundle 20*b* is conveyed to the processing tray 12.

Figure 15:
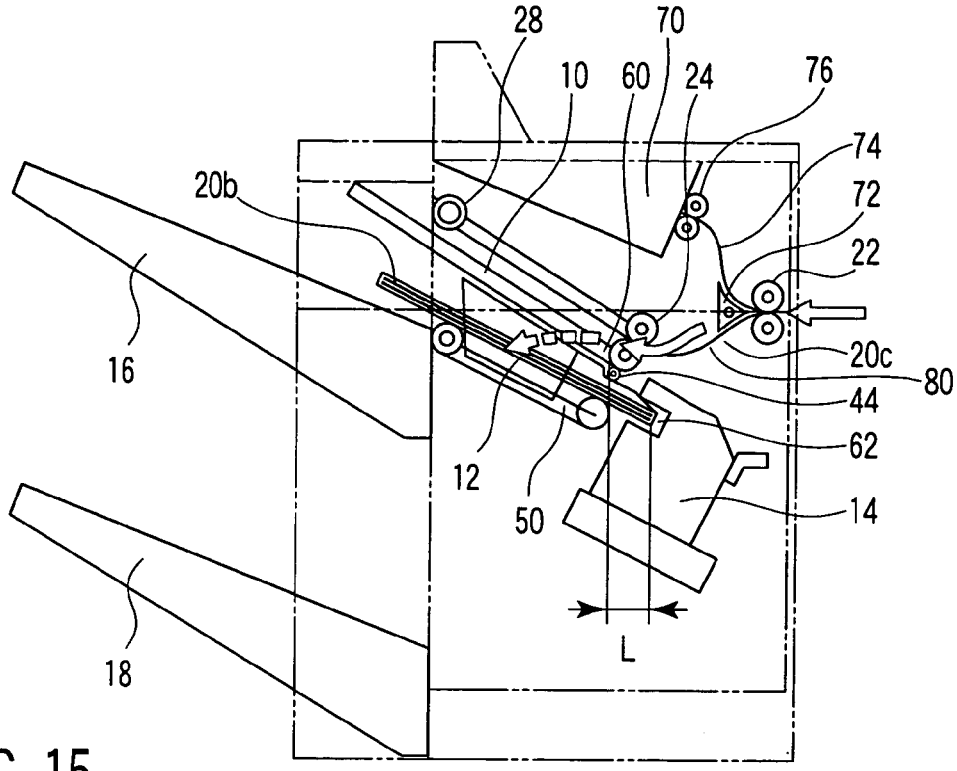
FIG. 15 is a sectional view of the apparatus, explaining how the third sheet is conveyed.

Thereafter, the third sheet 20*c* and some following sheets are conveyed from the sheet-feeding rollers 24 to the processing tray 12, not through the waiting tray 10, as illustrated in FIG. 15. These sheets are laid, one after another, upon the bundle 20*b* of two sheets. A bundle 21, which consists of the prescribed number of sheets, is formed on the processing tray 12. As the sheets including the third sheet 20 are sequentially laid on the bundle 20*b*, the longitudinal-alignment rollers 38 and the transverse-alignment mechanism 47 align the sheets at their longitudinal edges and transverse edges.

The waiting tray 10 must be positioned so that its rear end 60 may lie downstream of the rear end (upstream-side) of the processing tray 12 when the sheets are laid on the bundle 20*b*. As shown in FIG. 15, the rear end 60 of the waiting tray 10 is therefore spaced from the rear end 62 of the processing tray 12, by distance L, in the transverse direction. This enables the bundle 20*b* to fall smoothly from the waiting tray 10 onto the processing tray 12. This also makes it easy for both alignment mechanisms 38 and 47 to align sheets. Thus, jamming of sheets can be prevented.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

As seen from FIGS. 12 to 15, the sheet post-process apparatus has the following three characterizing features:

(1) The waiting tray 10 extends longer in the sheet-conveying direction than the length of sheets 20.

(2) The processing tray 12 extends shorter in the sheet-conveying direction than the length of sheets 20.

(3) Because of the feature (2), any sheet 20 that has fallen from the waiting tray 10 onto the processing tray 12 is supported not only by the processing tray 12, but also by the first storage tray 16.

These features (1), (2) and (3) reduce the size of the sheet post-process apparatus (i.e., finisher) in the sheet-conveying direction.

Figure 16:
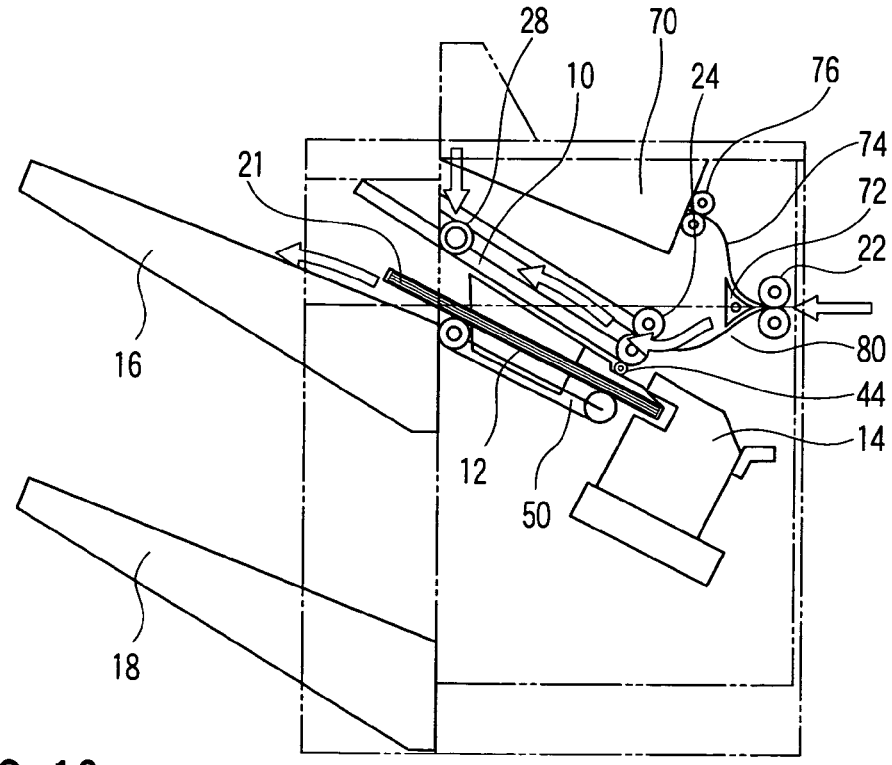
FIG. 16 is a sectional view of the apparatus, illustrating how the stapler operates.
Figure 17:
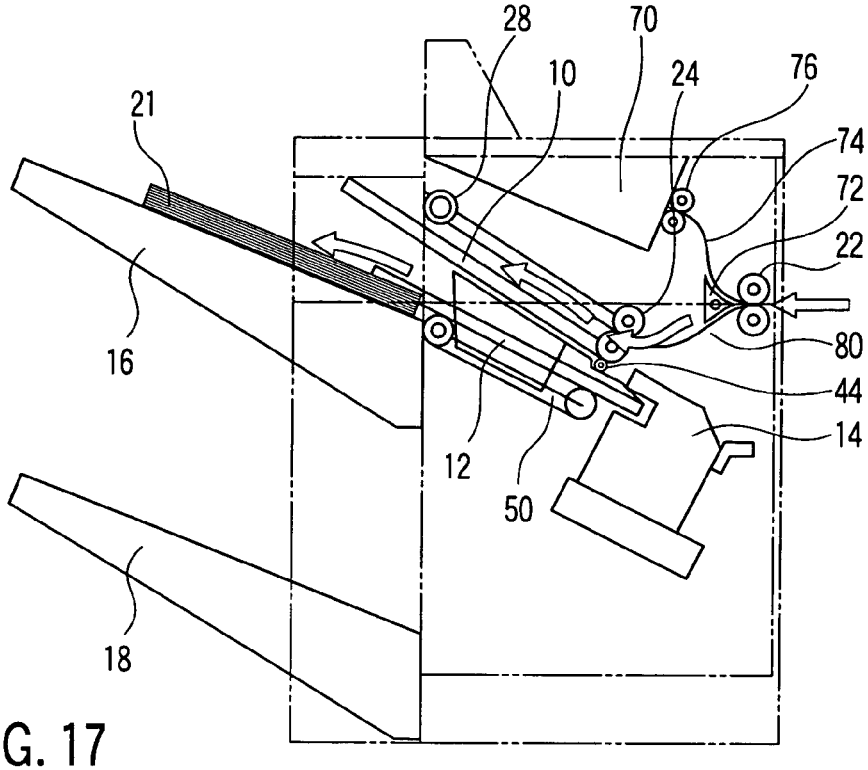
FIG. 17 is a sectional view of the apparatus, explaining how a bundle of sheets moves between the processing tray and the storage tray.

As FIG. 16 shows, the stapler 14 staples the bundle 21 of sheets. Then, the transport mechanism 50 transports the bundle 21 to the storage tray 16 as illustrated in FIG. 17. Thus, the post-process ends.

Figure 18:
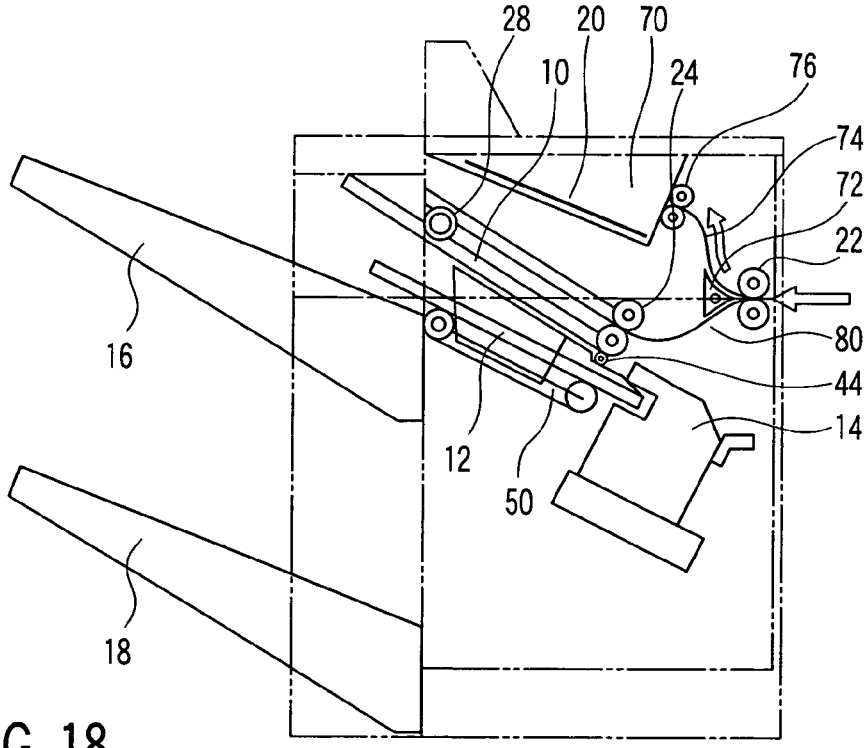
FIG. 18 is a sectional view of the apparatus, illustrating how sheets move from the waiting tray to the third storage tray.

If the sheets need not undergo the post-process, they are not conveyed to the waiting tray 10 and the processing tray 12 and directly ejected to the third storage tray 70 as depicted in FIG. 18. As FIG. 18 shows, the sheets supplied from the MFP are sequentially conveyed to the third storage tray 70 via the input rollers 22, gating device 72, second guide 74 and sheet-ejecting rollers 76.

One embodiment of the invention has been described. The invention is not limited to the embodiment, nevertheless. The components described above may be replaced with other components that are identical in function.

What is claimed is:

1. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed, the waiting tray having two waiting tray parts with one waiting tray part provided on each side of the some of the sheets and the waiting tray parts move in opposite directions from each other to form an opened position of the waiting tray;

a processing tray which holds the sheets conveyed from the waiting tray and other sheets forming the bundle of sheets before the bundle of sheets is post-processed;

a post-process mechanism which performs a post-process on the bundle of sheets on the processing tray;

a first storage tray and a second storage tray, each of which holds the bundle of sheets conveyed from the processing tray; and a third storage tray which holds sheets ejected without being conveyed to the waiting tray or the processing tray.

2. The sheet post-process apparatus according to claim 1, wherein the third storage tray has a cover that can be opened and closed.

3. The sheet post-process apparatus according to claim 1, further comprising a gating device which guides sheets to the third storage tray or the waiting tray.

4. The sheet post-process apparatus according to claim 1, wherein the first storage tray and the second storage tray are interchangeably used.

5. The sheet post-process apparatus according to claim 1, further comprising a sheet-conveying mechanism which conveys the post-processed bundle of sheets from the processing tray.

6. The sheet post-process apparatus according to claim 1, wherein the processing tray holds the other sheets conveyed via the conveying path without being conveyed to the waiting tray before the bundle of sheets is post-processed.

7. The sheet post-process apparatus according to claim 1, further comprising a sheet-aligning mechanism which aligns the bundle of sheets with one another on the processing tray at transverse and longitudinal edges.

8. The sheet post-process apparatus according to claim 1, further comprising an alignment mechanism to align the some of the sheets on the waiting tray.

9. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed, the waiting tray having two waiting tray parts with one waiting tray part provided on each side of the some of the sheets and the waiting tray parts move in opposite directions from each other to form an opened position of the waiting tray;

a processing tray which holds the sheets conveyed from the waiting tray and other sheets forming the bundle of sheets before the bundle of sheets is post-processed;

a post-process mechanism which performs a post-process on the bundle of sheets on the processing tray;

means for holding the bundle of sheets conveyed from the processing tray; and a storage tray that holds sheets ejected without being conveyed to the waiting tray or the processing tray.

10. The sheet post-process apparatus according to claim 9, wherein the storage tray has a cover that can be opened and closed.

11. The sheet post-process apparatus according to claim 10, further comprising a gating device which guides sheets to the storage tray or the waiting tray.

12. The sheet post-process apparatus according to claim 10, wherein the means for storing are interchangeably used.

13. The sheet post-process apparatus according to claim 9, further comprising a sheet-conveying mechanism which conveys the post-processed bundle of sheets from the processing tray.

14. The sheet post-process apparatus according to claim 9, wherein the processing tray holds the other sheets conveyed via the conveying path without being conveyed to the waiting tray before the bundle of sheets is post-processed.

15. The sheet post-process apparatus according to claim 9, further comprising a sheet-aligning mechanism which aligns the bundle of sheets with one another on the processing tray at transverse and longitudinal edges.

16. The sheet post-process apparatus according to claim 9, further comprising an alignment mechanism to align the some of the sheets on the waiting tray.

17. A method for post processing sheets, comprising:

receiving sheets from a multi-function peripheral and conveying the sheets forward;

providing a waiting tray in a conveying path for holding some of the sheets conveyed when a bundle of sheets needs to be post-processed, conveying the some of the sheets from the waiting tray to the processing tray by moving waiting tray parts provided on each side of the some of the sheets in opposite directions from each other to form an opened position of the waiting tray;

holding sheets conveyed by the waiting tray on a processing tray and other sheets forming the bundle of sheets before the bundle of sheets is post-processed;

performing a post-process on the bundle of sheets on the processing tray;

holding the bundle of sheets conveyed from the processing tray in a first storage tray or a second storage tray; and holding sheets ejected without being conveyed to the waiting tray or the processing tray in a third storage tray.

18. The method for post processing sheets according to claim 17, further comprising providing the third storage tray with a cover that can be opened and closed.

19. The method for post processing sheets according to claim 17, further comprising guiding sheets to the third storage tray or the waiting tray with a gating device.

20. The method for post processing sheets according to claim 17, further comprising interchangeably using the first storage tray and the second storage tray.

* * * * *